US007004342B2

(12) United States Patent
Bourque et al.

(10) Patent No.: US 7,004,342 B2
(45) **Date of Patent: *Feb. 28, 2006**

(54) CONTAINER WITH INTEGRATED VACUUM PANEL, LOGO AND/OR RECESSED GRIP PORTION

(75) Inventors: Raymond A. Bourque, Plymouth, MA (US); Ralph T. Coley, Jr., Cohasset, MA (US); Takao Iizuka, Koto-ku (JP); Masaaki Sasaki, Matsudo (JP)

(73) Assignee: Ocean Spray Cranberries, Inc., Lakeville-Middleboro, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/812,057

(22) Filed: Mar. 30, 2004

(65) Prior Publication Data

US 2004/0195200 A1 Oct. 7, 2004

Related U.S. Application Data

(63) Continuation of application No. 10/387,535, filed on Mar. 14, 2003, now Pat. No. 6,749,075, which is a continuation of application No. 10/051,138, filed on Jan. 22, 2002, now Pat. No. 6,575,321.

(60) Provisional application No. 60/262,641, filed on Jan. 22, 2001.

(51) Int. Cl.
*B65D 1/02* (2006.01)
*B65D 23/08* (2006.01)
*B65D 23/10* (2006.01)

(52) U.S. Cl. ..... 215/384; 215/365; 215/381; 215/398; 220/666; 220/669; 220/675; 220/771

(58) Field of Classification Search ..... 215/365, 215/379, 381, 382, 384, 398, 900; 220/666, 220/669, 675, 771

See application file for complete search history.

(56) References Cited

U.S. PATENT DOCUMENTS

| | | | |
|---|---|---|---|
| D214,550 | S | 7/1969 | Plummer |
| 4,155,474 | A | 5/1979 | Bizzarri |
| D278,977 | S | 5/1985 | Franchi et al. |
| 4,749,092 | A | 6/1988 | Sugiura et al. |
| 4,805,788 | A | 2/1989 | Akiho |
| 4,863,046 | A | 9/1989 | Collette et al. |

(Continued)

FOREIGN PATENT DOCUMENTS

| | | |
|---|---|---|
| EP | 0 356 829 | 3/1990 |

(Continued)

OTHER PUBLICATIONS

Graham Slide Presentation, "Design concepts—1997", p. 9.

(Continued)

*Primary Examiner*—Sue A. Weaver
(74) *Attorney, Agent, or Firm*—Nixon & Vanderhye P.C.

(57) ABSTRACT

A container includes a top portion and a bottom portion. The top portion includes a shoulder that extends away from a neck of the container, and a grip portion. The grip portion defines an integral logo portion and is recessed within the top portion of the container. A waist or groove is provided on adjacent lateral sides of the grip portion and may include a lateral stiffening rib. The bottom portion of the container includes a plurality of vacuum panels that accommodate for internal forces tending to cause collapse of the vacuum panels during a hot-fill process. Any portion of the internal forces not accommodated by the vacuum panels in the bottom portion of the container is accommodated by an auxiliary vacuum panel, which is provided in the grip portion of the container.

55 Claims, 4 Drawing Sheets

U.S. PATENT DOCUMENTS

| | | | | |
|---|---|---|---|---|
| 4,877,141 | A | 10/1989 | Hayashi et al. | |
| D308,482 | S | 6/1990 | Wild | |
| 5,054,632 | A | 10/1991 | Alberghini et al. | |
| 5,064,081 | A | 11/1991 | Hayashi et al. | |
| 5,067,622 | A | 11/1991 | Garver et al. | |
| 5,092,475 | A | 3/1992 | Krishnakumar et al. | |
| 5,141,120 | A | 8/1992 | Brown et al. | |
| 5,141,121 | A | 8/1992 | Brown et al. | |
| 5,148,930 | A | 9/1992 | Ota et al. | |
| 5,165,557 | A | 11/1992 | Ota et al. | |
| 5,178,289 | A | 1/1993 | Krishnakumar et al. | |
| 5,199,588 | A | 4/1993 | Hayashi | |
| 5,224,614 | A | 7/1993 | Bono et al. | |
| 5,238,129 | A | 8/1993 | Ota | |
| 5,279,433 | A | 1/1994 | Krishnakumar et al. | |
| 5,303,834 | A | 4/1994 | Krishnakumar et al. | |
| 5,337,909 | A | 8/1994 | Vailliencourt | |
| 5,341,946 | A | 8/1994 | Vailliencourt et al. | |
| 5,350,078 | A | 9/1994 | Potts et al. | |
| 5,381,910 | A * | 1/1995 | Sugiura et al. | 215/398 |
| 5,392,937 | A | 2/1995 | Prevot et al. | |
| 5,472,105 | A | 12/1995 | Krishnakumar et al. | |
| 5,732,838 | A | 3/1998 | Young | |
| 5,762,221 | A | 6/1998 | Tobias et al. | |
| 5,803,289 | A | 9/1998 | Brady | |
| 5,971,184 | A | 10/1999 | Krishnakumar et al. | 215/398 |
| 6,006,952 | A | 12/1999 | Lucas | 222/211 |
| D420,919 | S | 2/2000 | Ogg | D9/592 |
| 6,044,997 | A | 4/2000 | Ogg | 215/381 |
| D423,940 | S | 5/2000 | Chimetto | |
| 6,161,713 | A * | 12/2000 | Krich | 215/384 |
| 6,257,433 | B1 | 7/2001 | Ogg et al. | 215/381 |
| 6,273,282 | B1 | 8/2001 | Ogg et al. | 215/381 |
| D447,411 | S | 9/2001 | Lichtman et al. | D9/434 |
| D451,032 | S | 11/2001 | Iizuka et al. | |
| D451,033 | S | 11/2001 | Iizuka et al. | |
| D452,444 | S | 12/2001 | Iizuka et al. | |
| D459,234 | S | 6/2002 | Bourque et al. | |
| D467,505 | S | 12/2002 | Iizuka et al. | |
| 6,575,320 | B1 | 6/2003 | Ota et al. | 215/381 |
| 6,575,321 | B1 | 6/2003 | Bourque et al. | 215/384 |
| D481,318 | S | 10/2003 | Iizuka et al. | |
| 6,749,075 | B1 * | 6/2004 | Bourque et al. | 215/384 |
| 2003/0136754 | A1 | 7/2003 | Bourque et al. | 215/384 |
| 2003/0205550 | A1 * | 11/2003 | Prevot et al. | |
| 2005/0040132 | A1 | 2/2005 | Saito et al. | 215/384 |

FOREIGN PATENT DOCUMENTS

| | | |
|---|---|---|
| JP | 2585264 | 7/1994 |
| JP | 8-230856 | 9/1996 |
| JP | 2839012 | 10/1998 |
| WO | WO 02/32768 A1 | 4/2002 |

OTHER PUBLICATIONS

Graham Slide Presentation, "Design Concepts—1999", p. 10.

Graham Slide Presentation, "Selected Rectangular Bottles on the World Market since 1990's", p. 11.

European Search Report, Dec. 20, 2002, 10 pages.

Partial European Search Report, Sep. 23, 2002, 5 pages.

Slide 3 of Presentation to Ocean Spray, "1994 Launched first 'Pinch Grip' Bottle".

Slide 4 of Presentation to Ocean Spray, "1998 Launched first U.S. Rectangle Hot-fill Juice Bottle".

Slide 5 of Presentation to Ocean Spray, "1999 Launched first 'Round Grippable' Bottle".

Slide 6 of Presentation to Ocean Spray, "2000 Launched Improved Pinch Grip Bottle".

Slide 11 of Presentation to Ocean Spray, "Selected Rectangular Bottles on the World Market since 1990's".

Pictures (10 pages) of "TREETOP" Apple Juice Bottle, and licensee's description of "TREETOP" Bottle presented during negotiation of license, 1997 (according to licensee).

"Customer Concept Drawing" of Ocean Spray Bottle (Oct. 22, 1998).

"Customer Specification Drawing" of Ocean Spray Bottle (Jul. 18, 2000).

"Customer Product Drawing" of Veryfine Bottle (Feb. 17, 1998).

"32 oz. Custom Bell" (Jan. 26, 1996).

* cited by examiner

CONTAINER WITH INTEGRATED VACUUM PANEL, LOGO AND/OR RECESSED GRIP PORTION

CROSS-REFERENCE TO RELATED APPLICATIONS

This is a continuation of U.S. application Ser. No. 10/387,535, filed Mar. 14, 2003, now U.S. Pat. No. 6,749,075, which is a continuation of U.S. application Ser. No. 10/051,138, filed Jan. 22, 2002, now U.S. Pat. No. 6,575,321, which in turn claims the benefit of U.S. Provisional application Ser. No. 60/262,641, filed Jan. 22, 2001, the contents of each of which are incorporated herein by reference in their entirety.

BACKGROUND OF THE INVENTION

1. Field of the Invention

This invention relates to plastic containers. In particular, this invention relates to polyethylene terephthalate (PET) containers which may be hot-fillable and which include an improved grip portion, logo portion and/or vacuum panel configuration.

2. Description of Related Art

U.S. Pat. No. 5,762,221 discloses a hot-fillable, blow-molded plastic container having a reinforced dome at the upper portion of the container. The dome has a plurality of lands and grooves. Each land has a panel that further reinforces and strengthens each land. Each panel is located in the upper dome portion completely above the waist. Each panel can have an integral textured design formed thereon. For example, the panel could display a textured design of grapes or oranges, a brand, advertising or source type, or it can simply be for artistic purposes.

U.S. Pat. No. 5,067,622, incorporated herein by reference, discloses a PET container for hot-filled applications. The container includes conventional vacuum deformation panels that are formed in a frusto-conical neck segment. In addition, a vacuum panel may be provided in the base portion of the container.

U.S. Pat. Nos. 6,044,997 and Des. 420,919 disclose containers having a grippable container dome. Grip portions on the container dome may accommodate up to 5% of the volumetric shrinkage of the container due to hot fill, capping and cooling. The balance is accommodated by the vacuum panels in the lower portion of the container.

A need has developed in the art to develop a container having an easily grippable portion that is positioned closer to the center of gravity of the container and/or dimensioned with respect to its height, width and depth to improve the hand fit of the user. Another need has developed to more prominently display the source of origin, e.g., logos, etc., and to utilize the grippable portion as a vacuum panel and/or logo portion.

SUMMARY OF THE INVENTION

One aspect of the present invention is to provide a plastic, e.g., PET, container with an improved grip portion. The grip portion has a height, width and depth that are dimensioned to provide a good hand-fit to a wide variety of hand sizes. Further, the grip portion can be located closer to the center of gravity of the container to improve the ability to hold onto and pour liquid contents from the container.

Another aspect of the present invention is to provide a grip portion which also serves as a logo portion and/or an auxiliary vacuum panel. The logo portion can be enlarged to enhance product recognition.

According to one preferred embodiment of the present invention, there is provided a hot-fillable plastic container, comprising a body portion having a top portion and a bottom portion. The top portion includes a shoulder, a grip portion below the shoulder and inwardly recessed into the body portion and a ledge provided along at least one lateral extreme of the grip portion due to inwardly recessing the grip portion. The grip portion defines at least one first vacuum panel. The bottom portion includes a plurality of second vacuum panels and a base portion below the plurality of second vacuum panels. Each of the plurality of vacuum panels has a deformation capability that is different than a deformation capability of the at least one first vacuum panel.

In embodiments, the hot-fillable container may further comprise a plurality of lateral ribs positioned within each of the second vacuum panels, and/or at least one lateral rib provided on the top portion of the body portion and laterally adjacent the at least one first vacuum panel. The container may be substantially rectangular and define two longer sides and two shorter sides, each of the longer sides having at least one first vacuum panel, and each of the shorter sides including at least one horizontal rib provided on the upper portion of the body portion and laterally adjacent each at least one first vacuum panel. A waist portion may extend into the body portion, with the grip portion and the at least one first vacuum panel being provided laterally adjacent the waist portion. The at least one first vacuum panel provided in the grip portion may define an integral logo portion having a logo.

According to another preferred embodiment of the present invention, a hot-fillable plastic container comprises a top portion including a shoulder and a grip portion that is recessed about 2–10 mm into the top portion, and a bottom portion integrally formed with the top portion. The bottom portion includes a plurality of vacuum panels that accommodate internal forces tending to collapse the vacuum panels inwardly due to filling of the container with a liquid at an elevated temperature and subsequent cooling of the liquid. The grip portion in the top portion defines an auxiliary vacuum panel that accommodates for any portion of the internal forces not accommodated by the vacuum panels in the bottom portion.

According to yet another embodiment of the present invention, a plastic container comprises a body portion having a top portion and a bottom portion. The body portion defines a center of gravity in a region along a transition between the top and bottom portions. The top portion includes a shoulder and a grip portion that at least partially coincides with the center of gravity of the body portion. The bottom portion provides a surface that is adapted to receive a wrap-around label.

Some embodiments may include a plurality of vacuum panels in the bottom portion and an auxiliary vacuum panel in the grip portion. A waist portion may extend into the body portion, with the grip portion and the auxiliary vacuum panel being provided laterally adjacent the waist portion. The grip portion may define an auxiliary vacuum panel and logo integrally formed therewith.

According to still another aspect of the present invention, a container comprises a body portion having a top portion and a bottom portion integral with the top portion, the top portion having a generally rectangular shape defining two shorter sides and two longer sides, a grip portion provided in each of the longer sides of the top portion, a waist portion provided laterally adjacent the grip portion and along the two shorter sides of the top portion, and at least one laterally extending stiffening rib provided within the waist portion and laterally adjacent the grip portion.

Yet another embodiment of the invention is directed to a hot-fillable plastic container comprising a top portion including a shoulder, an inwardly depressed grip portion and a waist portion that extends into the top portion where the grip portion is positioned. A bottom portion is integrally formed with the top portion, the bottom portion including a plurality of vacuum panels that accommodate internal forces tending to collapse the vacuum panels inwardly due to filling of the container with a liquid at an elevated temperature and subsequent cooling of the liquid. The grip portion in the top portion defines an auxiliary vacuum panel that accommodates for any portion of the internal forces not accommodated by the vacuum panels in the bottom portion, and the container is substantially rectangular and defines at least a first side and a second side, the first side having said auxiliary vacuum panel, and at least the second side including the waist.

Still another aspect of the present invention is directed to a plastic container comprising a body portion having a top portion and a bottom portion, the top portion including a grip portion that has a height, width and depth that are dimensioned and structured to provide a good hand-fit for a variety of hand sizes. In embodiments, the height of the grip portion is about 25–50% of a height of the top portion, the width of the grip portion is about 50–90% of a width of the grip portion, and the depth of the grip portion is about 2–10 mm.

These and other aspects of the present invention will be described in or apparent from the following detailed description of preferred embodiments.

BRIEF DESCRIPTION OF THE DRAWINGS

Preferred embodiments of the invention will be described with reference to the following drawings, in which.

DETAILED DESCRIPTION OF PREFERRED EMBODIMENTS

Figure 1:
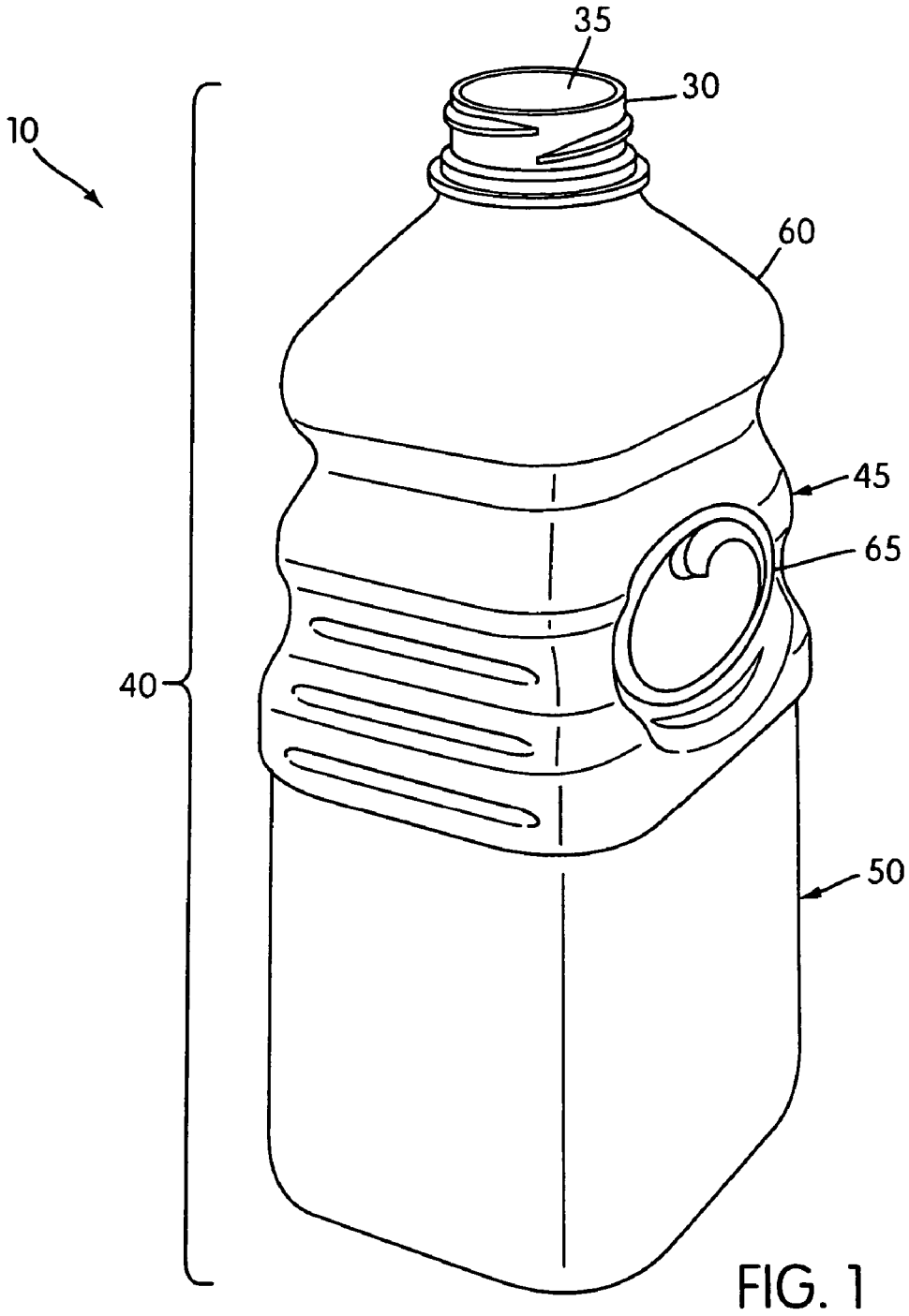
FIG. 1 is a perspective view from the top, front side of a container according to one preferred embodiment of the present invention.
Figure 2:
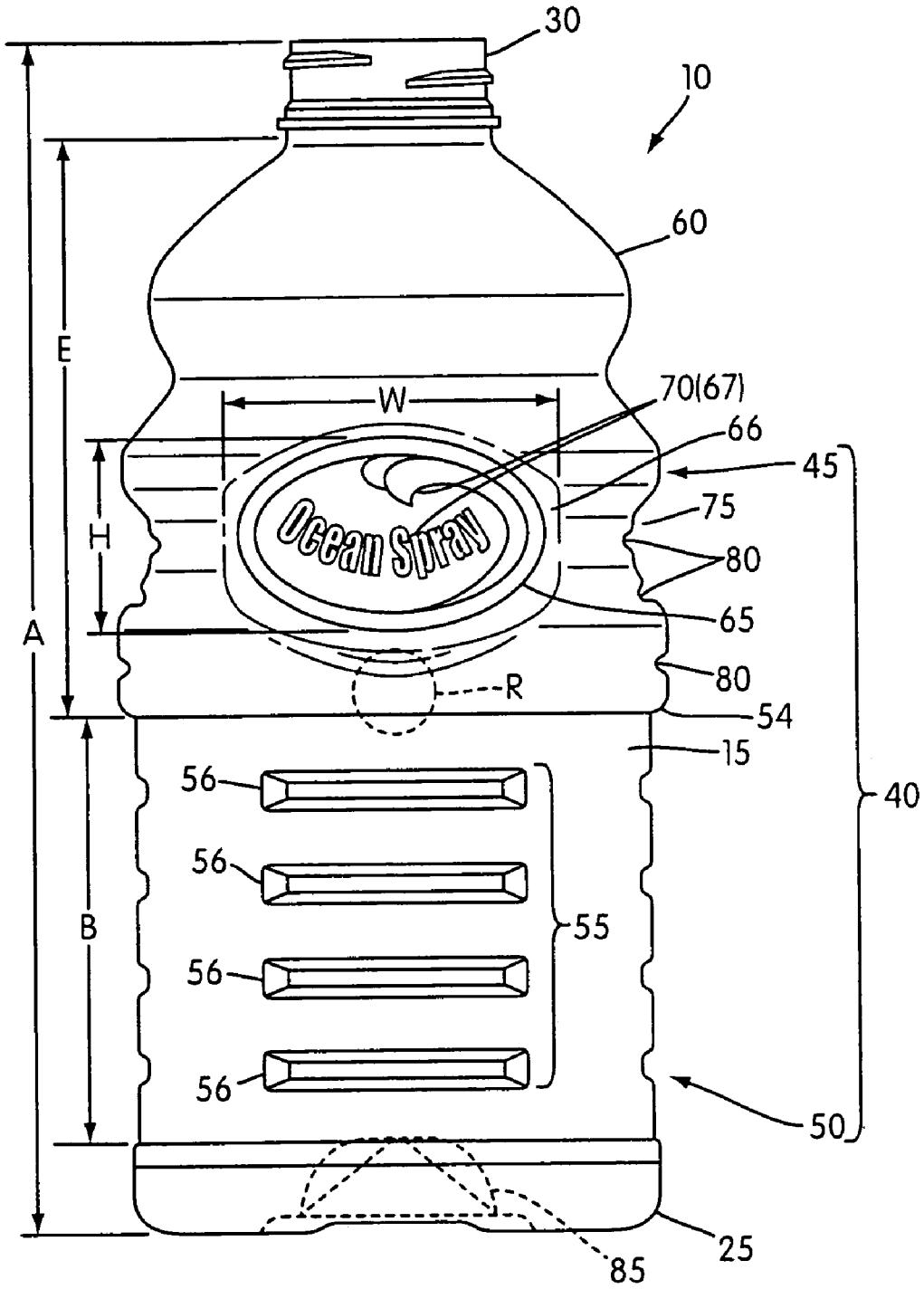
FIG. 2 is a front elevation view of a container according to the present invention, the rear view thereof being identical thereto.
Figure 3:
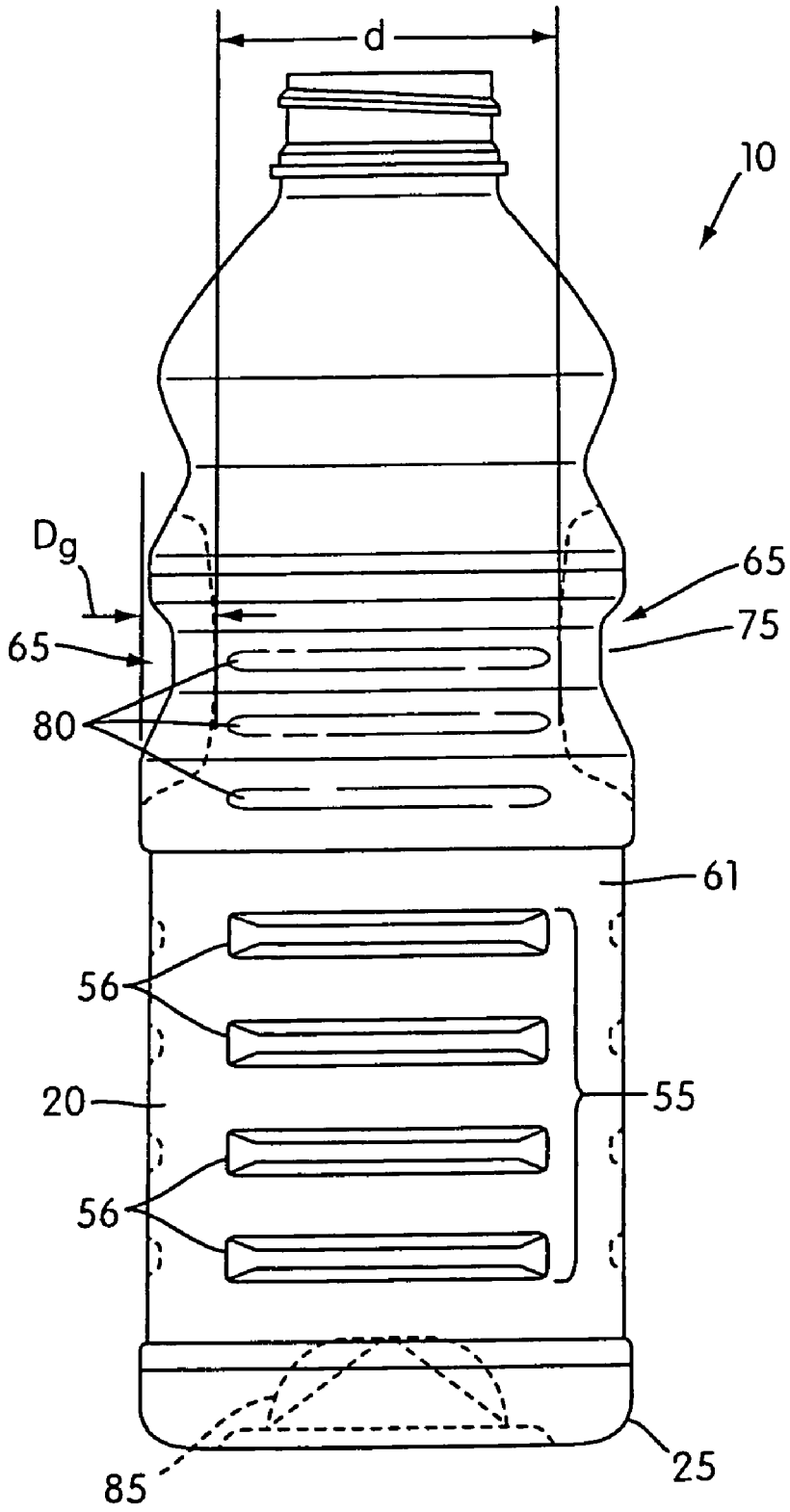
FIG. 3 is a left side view of the container shown in FIG. 2, with the opposite view thereof being identical thereto.
Figure 4:
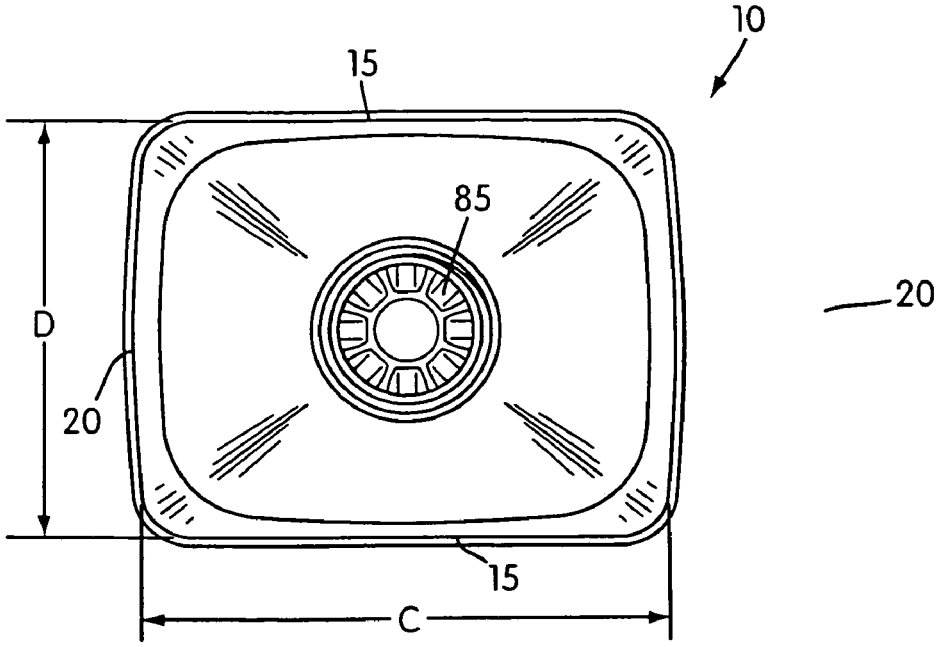
FIG. 4 is a top view of the container shown in FIG. 2.
Figure 5:
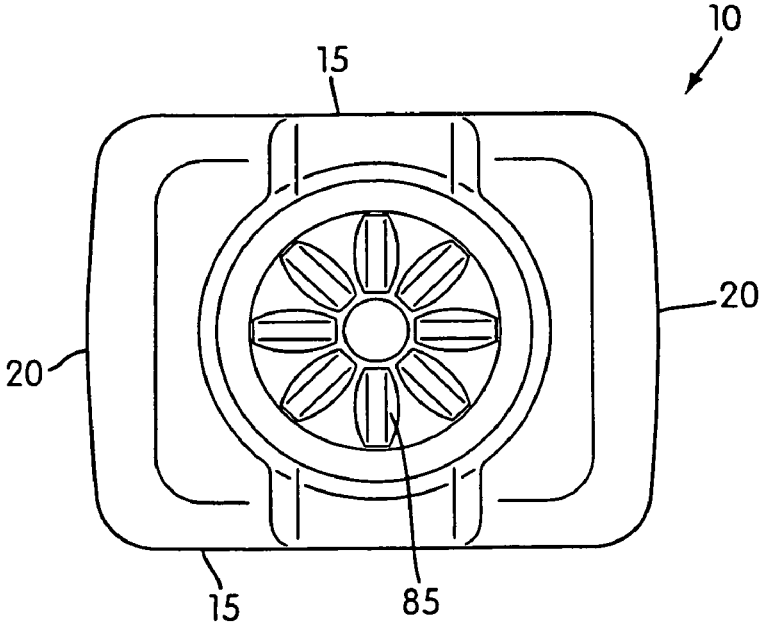
FIG. 5 is the bottom view of the container shown in FIG. 2.

FIGS. 1–5 show one preferred embodiment of the present invention. In the figures, reference number 10 designates a plastic, e.g. polyethylene terephthalate (PET), hot-fillable beverage container. As shown in FIG. 2, the container 10 has an overall height A of about 260 millimeters and a panel section height B of about 100 millimeters. The height A is selected so that the container 10 fits on the shelves of a supermarket. As shown in FIGS. 4 and 5, the container 10 is substantially rectangular, for example, and includes longer sides 15 each having a width C of about, e.g., 115 millimeters, and shorter sides 20 having a width D of about, e.g., 90 millimeters. The widths C and/or D are selected so that the container 10 can fit within the door shelf of a refrigerator. A base portion 25 (best shown in FIG. 2) of the container 10 has a width that is slightly greater than the widths C and D of the sides 15, 20 of the container 10. Provisional Application Ser. No. 60/262,641 shows additional exemplary dimensions of the container 10. In this particular embodiment, the container 10 has a volume capacity of about 64 oz. Those of ordinary skill in the art would appreciate that the following teachings of the present invention are applicable to other containers, such as round or square containers, which may have different dimensions and volume capacities. It is also contemplated that other modifications can be made depending on the specific application and environmental requirements.

The container 10 includes a neck 30 and a body portion 40 that extends away from the neck 30. The neck 30 may be crystallized to have a substantially opaque appearance, as is well known in the art. However, it is not necessary to provide a crystallized neck. The body portion 40 includes a top portion 45 and a bottom portion 50, which in the exemplary embodiment has a vacuum panel section that is shorter than the top portion 45. A base portion 25 is provided below the vacuum panel section.

The container 10 is manufactured, for example, using a blow-molding process which is well known. During blow-molding, a preform (not shown) is expanded and assumes the shape of an interior molding surface, i.e., a mold (not shown), to form a substantially transparent, biaxially-oriented container. The neck 30 of the preform is not expanded and remains as the neck 30 of the container 10. The neck 30 includes threads and an open mouth 35 for receiving a screw-on cap (not shown). The lower portion of the preform is expanded to form the body portion 40 of the container 10, including the top portion 45 and the bottom portion 50.

The bottom portion 50 of the container 10, as shown in FIGS. 2 and 3, includes a panel section having a plurality of conventional vacuum panels 55. The base 25 is provided below the vacuum panels 55. For example, each of the longer and shorter sides 15, 20 of the container 10 includes a vacuum panel 55. The vacuum panels 55 accommodate internal forces tending to collapse the vacuum panel 55 inwardly due to filling of the container 10 with a liquid at an elevated temperature, e.g., pasteurization temperature. After the container 10 is hot-filled and capped, cooling of the liquid tends to collapse the vacuum panels 55. Each vacuum panel 55 may include at least one, e.g., four, lateral stiffening ribs 56 to add rigidity, e.g., to prevent more than a certain amount of deformation of the vacuum panels 55. The vacuum panels 55 on the shorter sides 15 generally accommodate a lesser amount of the internal forces as compared to the vacuum panels on the larger sides 20. Further, the bottom portion 50 of the container 10 is adapted to receive a label 61 (FIG. 3) which is wrapped, e.g., shrink-wrapped, around the vacuum panels 55. For example, the label 61 wraps about the entire perimeter of the container 10. The label 61 is positioned below a transition shoulder 54 between the top and bottom portions 45, 50 of the body portion 40.

A grip portion 65 is provided below shoulder 60. The grip portion 65 is inwardly recessed into the body portion 40. For example, the grip portions 65 on opposite sides of the container 10 are spaced a distance that is less than a width of the top portion of the container. Preferably, each grip portion 65 is recessed a depth $D_g$ which is about 2–10 mm, and more preferably, about 5 mm into the body portion 40. As a result, the border of each grip portion 65 includes a ledge 66 (FIG. 2) that improves gripability. Preferably, the ledge substantially surrounds the entire grip portion 65, although it is also possible that less than the entire perimeter of the grip portion 65 includes the ledge. For example, the ledge may be limited to just the lateral (left and right) sides or one side of the grip portion 65, where the user grips the container 10. Further, although the grip portion 65 is shown as generally oval shaped, it can take the form of other shapes such as circles, diamonds, rectangles or other geometric shapes.

The grip portion 65 has a height H which is about one quarter to about one half, and preferably one third, of a height E of the top portion 45 of the body portion 40. The grip portion 65 is adapted to be grasped by the fingers and thumb of a person of average size, for example, an average woman having a size 7 hand. For example, as shown in FIG. 3, the distance d between the grip portions 65 is about 83 mm, although the distance d can range from about 75 to about 90 mm. However, the grip portion 65 is not limited for use by a person having average size hands. In this context, the width of the grip portion 65 is designed to be about 50–90% of the width of the container side wall on which it is placed. Preferably, the width is 60–80%, and most preferably the width is about 70% of the width of the side wall. By selecting and structuring the height, width and depth of the grip portions 65 using the above dimensions, user comfort is enhanced, a good hand-fit is achieved, and the grip portions 65 can be manipulated by a persons having a wide variety of hand sizes.

The grip portion 65 is provided near the center of gravity of the container 10. The center of gravity of the container 10, assuming it is filled, is just below the logo portion, and can be calculated by those of ordinary skill in the art. For example, the center of gravity for a filled container 10 can be in the region R, as shown in FIG. 2. As shown, the grip portion 65 has a lowermost point that coincides with the region R defining the center of gravity, and extends to a height of between about 25–50% of the height of the top portion 45 of the container 10. Thus, positioning of the grip portions 65 facilitates holding of and pouring liquid contents from the container 10.

Further, the grip portion 65 may also serve as a logo portion. As shown, each grip portion 65, may include a logo 70 (FIG. 2), such as "Ocean Spray®" and/or the Ocean Spray® "wave". The logo may include an anti-slip surface in the form of raised or embossed (depressed) lettering, logos, characters or other designs, which helps prevent the container 10 from slipping out of the user's fingers and thumb. Further, in addition-to or instead of using integrally formed lettering, designs or logos, the logo may be in the form of a label 67 that is applied, e.g., using an adhesive, to the grip portion 65. Stated differently, the grip portion 65 may also form an auxiliary label portion, which may be coordinated with the wrap-around label provided on the bottom portion of the container 10. If an integrally formed logo is used with the label 67, then it is recommended that the integral logo be embossed into the grip portion, rather than being raised, so as to present a more flat surface to which the label 67 may be secured. Because of the increased size of the grip portion, the logo 70 can be more prominently displayed on the container 10.

Because of the relatively large size of the logo 70, the top portion 45 of the container 10 can be longer than the bottom portion 50 of the container 10, where the vacuum panels 55 are positioned. Thus, the vacuum panels 55 may not be sufficient to compensate for the amount of internal vacuum forces that tend to collapse the vacuum panels 55 during the hot-fill process. As such, the grip portion 65 is also designed such that it can act as an auxiliary vacuum panel by flexing inwardly during cooling and volumetric shrinkage to accommodate any additional internal vacuum forces that are not accommodated by the vacuum panels 55 in the bottom portion 50 of the container 10.

The grip portion 70 is positioned, e.g., along the longer sides 15 of the container 10. The shorter sides 20 of the container 10 include a waist portion 75 that is positioned laterally adjacent the grip portion 65 and logo 70. Each of the shorter sides 20 may include at least one lateral stiffening rib 80 positioned within the waist portion 75. The rib 80 serves to prevent excessive deformation of the auxiliary vacuum panel during the hot-fill process. The rib 80 is configured slightly differently than the ribs 56.

The base portion 25 of the container 10 has a dome-shaped portion 85 which increases strength of the container 10 and facilitates the manufacturing process. The configuration and shape of the dome-shaped portion 85 may also help assist in the compensation for internal forces created during the hot-fill process, as is known in the art.

Preferred embodiments of the present invention have been described with reference to FIGS. 1–5. Variations and modifications of the preferred embodiments will be apparent to those of ordinary skill in the art without departing from the spirit and scope of the present invention. For example, while an exemplary hot-fillable container has been described, the disclosure is not limited to such and non-hot-fillable containers are also possible, in which event vacuum panels would not be required. In addition, while PET containers made using a blow-molding process have been described, other materials and manufacturing processes are also possible. For example, the container can be made using extrusion molding or other stretch molding techniques, and the container could be made from materials such as, for example, polypropylene, high density polypropylene, polyolefin, styrene and other similar plastic materials.

What is claimed is:

1. A hot-fillable plastic container, comprising:

a body portion having a top portion and a bottom portion, the top portion including a grip portion inwardly recessed at least 5 mm into the body portion and a grip edge provided along at least an upper side of the grip portion due to inward recessing of the grip portion, wherein the grip edge forms a transition between the recessed grip portion and a non-recessed wall portion of the top portion of the body portion adjacent the grip portion, the grip portion being designed to accommodate at least a portion of internal forces tending to collapse the container inwardly due to filling of the container with a liquid at an elevated temperature and subsequent cooling of the liquid, the bottom portion including a base portion and a plurality of vacuum panels designed to accommodate at least a portion of said internal forces, said plurality of vacuum panels having a deformation capability that is different than a deformation capability of the grip portions.

2. The hot-fillable container according to claim 1, further comprising a plurality of lateral ribs positioned within each of the vacuum panels.

3. The hot-fillable container according to claim 1, further comprising at least one lateral rib provided on the top portion of the body portion and on a sidewall of the container that is laterally adjacent each said grip portion.

4. The hot-fillable container according to claim 1, wherein the deformation capability of the grip portions is less than the deformation capability of the vacuum panels.

5. The hot-fillable container according to claim 1, wherein the container is substantially rectangular and defines two longer sides and two shorter sides, each of the longer sides having one said grip portion, and each of the shorter sides including at least one horizontal rib provided on the top portion of the body portion and laterally adjacent each said grip portion.

6. The hot-fillable container according to claim 1, further comprising a waist portion that extends into the body portion, the grip portion being provided laterally adjacent the waist portion.

7. The hot-fillable container according to claim 6, further comprising at least one lateral rib provided in the waist portion.

8. The hot-fillable container according to claim 1, wherein the grip portion is positioned substantially along a center of gravity of the body portion.

9. The hot-fillable container according to claim 1, wherein at least one said grip portion defines an integral logo portion having a logo.

10. The hot-fillable container according to claim 9, wherein the logo includes raised lettering.

11. The hot-fillable container according to claim 9, wherein the logo includes recessed lettering.

12. The hot-fillable container according to claim 9, wherein the logo portion has a height that is about one quarter to about one-half of a height of the top portion.

13. The hot-fillable container according to claim 1, wherein the bottom portion includes structure to accommodate a wrap-around label.

14. The hot-fillable container according to claim 1, wherein the grip portion defines a logo portion adapted to receive an auxiliary label.

15. The hot-fillable container according to claim 1, wherein the grip edge substantially circumscribes the grip portion.

16. The hot-fillable container according to claim 1, wherein a cross-sectional shape of the body portion and the base portion is substantially rectangular along substantially an entire axial extent thereof.

17. The hot-fillable plastic container according to claim 1, wherein a center of gravity of the container is positioned in a region of the body portion spanning a transition between the top and the bottom portions.

18. The hot-fillable container according to claim 1, wherein the vacuum panels are positioned above the base portion.

19. The hot-fillable container according to claim 1, wherein the container includes one said grip portion on opposed side walls of the top portion, a capacity of the container is about 64 ounces, the bottom portion includes structure to accommodate a wrap around label, and each said grip portion includes a recessed design in the form of a logo.

20. A hot-fillable plastic container comprising:

a top portion including an inwardly depressed grip portion and a waist portion that extends into the top portion; and a bottom portion integrally formed with the top portion, the bottom portion including a base portion and a plurality of force accommodation portions to accommodate internal forces tending to collapse the container due to filling of the container with a liquid at an elevated temperature and subsequent cooling of the liquid, wherein the grip portion is designed to accommodate for at least a portion of the internal forces, and wherein a cross-sectional shape of the top and bottom portions of the container is substantially rectangular along substantially an entire axial extent thereof, and the top portion of the container defines relatively longer opposed sides, each having at least one said grip portion, and relatively shorter sides each having at least one said waist portion.

21. A hot-fillable PET plastic container, comprising:

a body portion having a top portion and a bottom portion each defining a pair of opposed relatively longer walls and a pair of opposed relatively shorter walls, the body portion including corner portions connecting the relatively longer and shorter walls, the top portion including a pair of opposed grip portions each inwardly recessed at least 2 mm with respect to the relatively longer walls of the top portion, each said grip portion having a grip edge provided along at least a portion of a perimeter of each grip portion due to inward recessing of the grip portions, wherein:

each said grip edge forms a transition between each said recessed grip portion and at least one non-recessed wall portion of the top portion adjacent the grip portion, and the bottom portion includes a base portion and a plurality of internal force accommodation portions, the base portion including a pair of opposed relatively shorter sides and a pair of opposed relatively longer sides corresponding, respectively, to the relatively shorter and longer walls of the body portion, each of the accommodation portions being structured to accommodate internal forces tending to collapse the container inwardly due to filling of the container with a liquid at an elevated temperature and subsequent cooling of the liquid, wherein:

the bottom portion includes structure to receive a wrap-around label positioned above the base portion and below the top portion to cover the longer and shorter walls in the bottom portion.

22. The hot-fillable container according to claim 21, wherein each of the grip portions is designed to accommodate for at least a portion of said internal forces, said grip portions having a deformation capacity that is less than a deformation capacity of the accommodation portions in the bottom portion.

23. The hot-fillable container according to claim 21, wherein the body portion defines a center of gravity in a region along a transition between the top and bottom portions, and each of the grip portions at least partially coincides with the center of gravity of the body portion.

24. The hot-fillable container according to claim 21, wherein a cross-sectional shape of at least the body portion is substantially rectangular along an entire axial extent thereof.

25. The hot-fillable container according to claim 21, wherein each said grip portion is recessed about 2–10 mm into the top portion.

26. The hot-fillable container according to claim 21, wherein each said grip portion is recessed more than 5 mm into the top portion.

27. The hot-fillable container according to claim 21, wherein a distance between the grip portions is about 75–90 mm.

28. A hot-fillable PET plastic container, comprising:

a body portion having a top portion and a bottom portion each defining a pair of opposed relatively longer walls and a pair of opposed relatively shorter walls, the body portion including corner portions connecting the relatively longer and shorter walls, the top portion including a pair of opposed grip portions each inwardly recessed at least 2 mm with respect to the relatively longer walls of the top portion, each said grip portion having a grip edge provided along at least curved upper and lower portions of each grip portion due to inward recessing of the grip portions, wherein:

each said grip edge forms a transition between each said recessed grip portion and at least one non-recessed wall portion of the top portion adjacent the grip portion, and the bottom portion includes a base portion and a plurality of internal force accommodation portions, the base portion including a pair of opposed relatively shorter sides and a pair of opposed relatively longer sides corresponding, respectively, to the relatively shorter and longer walls of the body portion, each of the accommodation portions being structured to accommodate internal forces tending to collapse the container inwardly due to filling of the container with a liquid at an elevated temperature and subsequent cooling of the liquid, wherein:

the bottom portion includes structure to receive a wrap-around label positioned above the base portion and below the top portion to cover the longer and shorter walls in the bottom portion.

29. The hot-fillable container according to claim 28, wherein each of the grip portions is designed to accommodate for at least a portion of said internal forces, said grip portions having a deformation capacity that is less than a deformation capacity of the accommodation portions in the bottom portion.

30. The hot-fillable container according to claim 28, wherein the body portion defines a center of gravity in a region along a transition between the top and bottom portions, and each of the grip portions is closely adjacent or partially coincides with the center of gravity of the body portion.

31. The hot-fillable container according to claim 28, wherein a cross-sectional shape of at least the body portion is substantially rectangular along an entire axial extent thereof.

32. The hot-fillable container according to claim 28, wherein each said grip portion is recessed about 2–10 mm into the top portion.

33. The hot-fillable container according to claim 28, wherein each said grip portion is recessed more than 5 mm into the top portion.

34. The hot-fillable container according to claim 28, wherein the structure to receive a wrap-around label includes upper and lower label bumpers, and wherein a height (B) between the upper and lower label bumpers is less than a height (E) between the upper label bumper and the base of the neck portion of the container.

35. The hot-fillable container according to claim 28, further comprising at least one recessed waist portion provided to each of the relatively shorter walls of the top portion of the body portion, laterally adjacent the grip portions.

36. The hot-fillable container according to claim 28, wherein each said grip portion includes an anti-slip surface.

37. The hot-fillable container according to claim 28, wherein each of the force accommodation portions in the relatively longer walls of bottom portion includes at least three strengthening ribs.

38. The hot-fillable container according to claim 28, wherein each of the relatively shorter walls of the bottom portion includes one said force accommodation portion.

39. The hot-fillable container according to claim 28, further comprising a wrap-around label.

40. The hot-fillable container according to claim 28, further comprising a raised letter molded logo positioned in the relatively longer walls of the top portion of the body portion.

41. The hot-fillable container according to claim 28, wherein a distance between the grip portions is about 75–90 mm.

42. The hot-fillable container according to claim 28, wherein a width of each of the relatively longer walls is about 115 mm.

43. The hot-fillable container according to claim 28, wherein a height of the container is about 260 mm.

44. The hot-fillable container according to claim 28, wherein a capacity of the container is about 64 ounces.

45. A hot-fillable PET plastic container, comprising:

a body portion having a top portion and a bottom portion each defining a pair of opposed relatively longer walls and a pair of opposed relatively shorter walls, the body portion including corner portions connecting the relatively longer and shorter walls, the top portion including a pair of opposed grip portions each inwardly recessed at least 2 mm with respect to the relatively longer walls of the top portion, wherein each said grip portion has a height that is about one quarter to about one-half of a height of the top portion, the bottom portion including a base and a plurality of internal force accommodation portions, each of the accommodation portions being structured to accommodate internal forces tending to collapse the container inwardly due to filling of the container with a liquid at an elevated temperature and subsequent cooling of the liquid, wherein:

the bottom portion includes structure to receive and position a wrap-around label, each of the two relatively shorter walls in the top portion includes a waist portion, each grip portion has a height that is about one quarter to about one-half of a height of the top portion, a capacity of the container is about 64 ounces, and each grip portion defines a molded logo portion including raised or depressed lettering.

46. The hot-fillable container according to claim 45, wherein a cross-sectional shape of the body portion and the base portion is substantially rectangular along substantially an entire axial extent thereof.

47. The hot-fillable container according to claim 45, further comprising a grip edge that partially circumscribes the grip portion.

48. The hot-fillable container according to claim 45, wherein a center of gravity of the container is positioned in a region of the body portion spanning a transition between the top and the bottom portions.

49. The hot-fillable container according to claim 45, wherein the accommodation portions are positioned above the base portion.

50. The hot-fillable container according to claim 40, wherein the accommodation portions include at least two opposed vacuum panels each including at least four horizontal strengthening ribs.

51. The hot-fillable container according to claim 45, wherein each said grip portion is inwardly recessed at least 5 mm.

52. The hot-fillable container according to claim 45, wherein each of the larger and shorter walls of the bottom portion includes at least one said accommodation portion.

53. The hot-fillable container according to claim 45, wherein each grip portion is centrally located within the longer walls of the top portion, so that the container is gripable from the direction of either of the shorter walls.

54. The hot-fillable container according to claim 45, wherein each grip portion includes a grip edge structured to help prevent inadvertent slipping when the container is held upright and when liquid contents are dispensed.

55. The hot-fillable container according to claim 45, wherein the container is filled with about 64 ounces of liquid contents.

* * * * *